United States Patent [19]

Reiter et al.

[11] Patent Number: 4,581,683

[45] Date of Patent: Apr. 8, 1986

[54] ELECTROLUMINESCENT LIGHTING FIXTURE

[75] Inventors: Eli Reiter, Dix Hills; Joseph R. Robson, Smithtown; Joseph W. Latinski, Commack, all of N.Y.

[73] Assignee: General Aero Products Corp., Copaigue, N.Y.

[21] Appl. No.: 666,930

[22] Filed: Oct. 31, 1984

[51] Int. Cl.[4] ..... F21V 9/14

[52] U.S. Cl. ..... 362/62; 362/27; 362/23; 362/30

[58] Field of Search ..... 362/62, 19, 29, 30, 362/216, 290, 23, 27, 28, 85, 61, 293

[56] References Cited

U.S. PATENT DOCUMENTS

| | | | |
|---|---|---|---|
| 2,664,848 | 1/1954 | Nauth | 362/23 |
| 2,712,593 | 7/1955 | Merchant | 362/27 |
| 2,837,628 | 6/1958 | Lamb et al. | 362/27 |
| 2,874,268 | 2/1959 | Martin | 362/27 |
| 3,027,669 | 4/1962 | Hardesty | 362/23 |
| 3,068,833 | 12/1962 | Hoffman | 362/23 |
| 3,120,349 | 2/1964 | Howland | 362/30 |
| 3,320,412 | 5/1967 | Howland | 362/28 |
| 3,433,940 | 3/1969 | Baez et al. | 362/27 |
| 4,328,532 | 5/1982 | Smith | 362/19 |
| 4,418,377 | 11/1983 | Tamura | 362/19 |

*Primary Examiner*—Raymond A. Nelli

*Attorney, Agent, or Firm*—David P. Gordon

[57] ABSTRACT

An electroluminescent light fixture is provided which is designed for use in military aircraft which is especially arranged for night viewing compatibility either by the naked eye or with the night vision goggles of an aircraft pilot. The fixture generally comprises a frame which prevents an observer from directly viewing the source of light, an electroluminescent strip adjacent the outer portion of the frame, and a lens of a modified torus shape which is adjacent the EL strip and which pipes the light of the EL strip towards the face of the instrument. The lens is configured with a light-emitting face which is optimally angled from the normal to the instrument dial surface such that maximal uniformity of illumination is provided. Two light-emitting faces angled at different angles may be provided to highlight dial pointers. The lens is also preferably pigmented so as to eliminate undesired reflections and glare. In one embodiment, the lighting fixture snaps on and sits around the bezel of the particular instrument which is to be illuminated. In another embodiment, the lighting fixture is incorporated inside the instrument.

22 Claims, 7 Drawing Figures

10
12
14
20
24
30
32
35
40
42
44
50
54
56
58
2
4

FIG. 3.
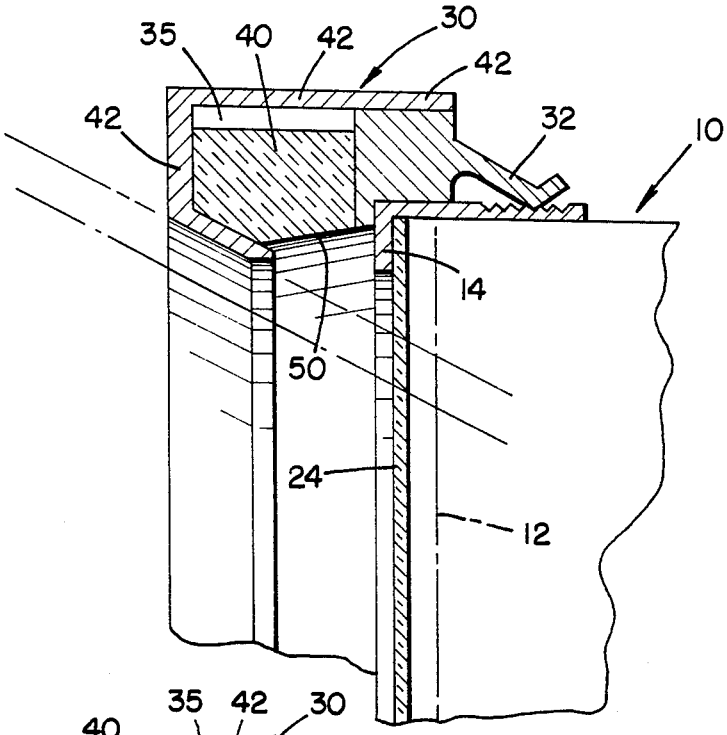
FIG. 5.
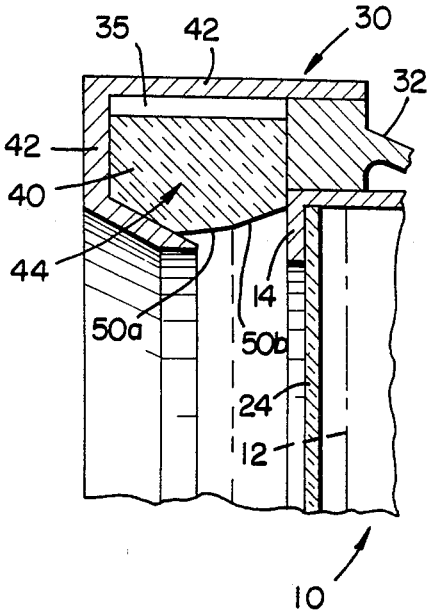
FIG. 6.
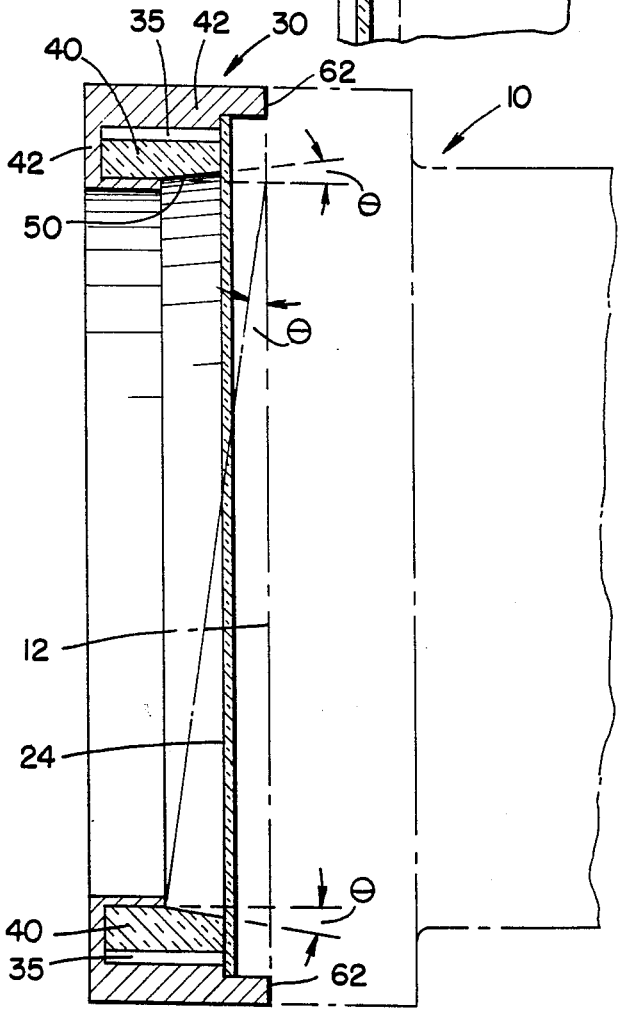
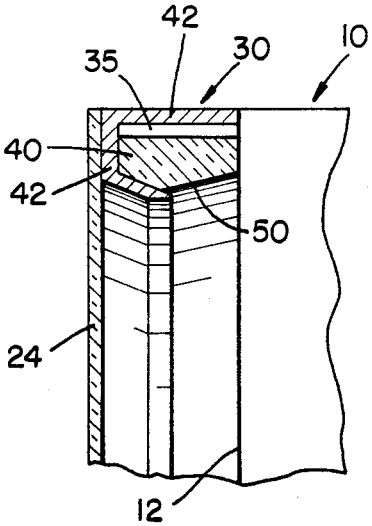
FIG. 7.

ELECTROLUMINESCENT LIGHTING FIXTURE

BACKGROUND OF THE INVENTION

The present invention relates to electroluminescent lighting fixtures for lighting the face or dial of an instrument. More particularly, the invention relates to electroluminescent lighting fixtures designed for use in military aircraft which are especially arranged for viewing compatibility with both the naked eye and with the night vision goggles of an aircraft pilot.

In providing lighting for an instrument, it is advantageous to provide low intensity light which uniformly lights the instrument and which does not produce undesirable reflections and glare. It is also advantageous to provide a fixture which is mechanically compatible with the instrument it is to light, especially where retrofitting is to be used to replace the previous light source or to add illumination to an instrument which previously was not lit. Various apparatus have been proposed and are presently being utilized in illuminating the faces (dials) of instruments on military aircraft. Most apparatus use incandescent lamps which provide light which is either non-compatible with night vision viewing, too great in intensity to be used with night vision goggles, or which is non-uniform when reduced in intensity. Also, when incandescent lighting is provided around the dial, undesirable reflections and glare result.

U.S. Pat. No. 4,328,532 to Richard A. Smith, discloses a light source which purportedly eliminates some of the difficulties of the prior art by providing a lighting fixture comprising a housing with a centrally disposed opening and an inner cylindrical wall, an electroluminescent lamp adjacent the wall, a microlouver light shield placed over the lamp to prevent viewing of the intense light and to eliminate reflections, and a polarizer placed between the lamp and the microlouver shield to polarize the light and reduce reflection and glare. According to the Smith, the described apparatus provides a uniform illumination of the face of the instrument and permits viewing through night vision goggles. However, because microlouver shields are commercially available with the louvers at only a couple of predetermined angles and because the microlouvers by their nature block out light, the Smith device does not provide the brightness and uniformity of illumination over the entire face of the instrument diel that is desired. Moreover, the Smith device is difficult and expensive to manufacture and assemble, is not configured to be mounted within an instrument enclosure, and is not necessarily easily attached to existing instruments.

SUMMARY OF THE INVENTION

It is therefore an object of this invention to provide an electroluminescent light fixture which provides a desired intensity, brightness, and uniformity of illumination over the entire face of an instrument.

It is a further object of this invention to provide an electroluminescent light fixture compatible with night vision viewing either by the naked eye or through night vision devices, the fixture being inexpensive to produce and easily attachable to existing aircraft instruments or included within the instrument when installed in an aircraft.

In accordance with the objects of the invention, an electroluminescent light fixture is provided which snaps on and sits around the bezel of the particular instrument which is to be illuminated. The fixture generally comprises a frame having a shell portion which prevents an observer from directly viewing the source of light and a finger portion for gripping the instrument, an electroluminescent strip (EL strip or lamp) adjacent the outer portion of the frame, and a lens of a modified torus shape which is adjacent the EL strip and which pipes the light of the EL strip towards the face of the instrument. The lens is so configured so as to permit the illumination of the entire face of the instrument in a uniform manner. Thus, for maximal uniformity of illumination of a two inch diameter instrument, the face of the lens from which the light emanating from the lamp exits the lens is optimally angled at 6–11 degrees from the normal to the instrument dial surface. The lens is also preferably pigmented so as to eliminate undesired reflections and glare.

With the above-summarized configuration, the invention provides an electroluminescent lighting fixture which is compatible with night vision viewing and which produces a uniformity of illumination without reflection or glare which is unmatched by the prior art. In addition, the lighting fixture is inexpensive, easily attached to existing aircraft instruments, and is easily arranged to be mounted within the instrument enclosure during manufacture of the instrument. Moreover, the pigmentation which eliminates undesired reflection and glare and which helps control light intensity and color, may be provided, upon manufacture, according to individual requirements or tastes.

A better understanding of the invention, and additional advantages and objects of the invention will become apparent to those skilled in the art upon reference to the detailed description and the accompanying drawings where like numerals represent like parts.

BRIEF DESCRIPTION OF THE DRAWINGS

FIG. 3 is the sectional view of the lighting fixture of FIG. 2 with improved features;

FIG. 5 is a partial sectional view of a lighting fixture of an alternate embodiment of the invention;

FIG. 6 is the sectional view of the embodiment of the lighting fixture invention where the fixture is mounted on a square instrument panel; and FIG. 7 is a sectional view of the instrument and lighting fixture in the embodiment wherein the lighting fixture is mounted within the instrument enclosure.

DETAILED DESCRIPTION OF THE PREFERRED EMBODIMENT

Figures 1, 2, 4:
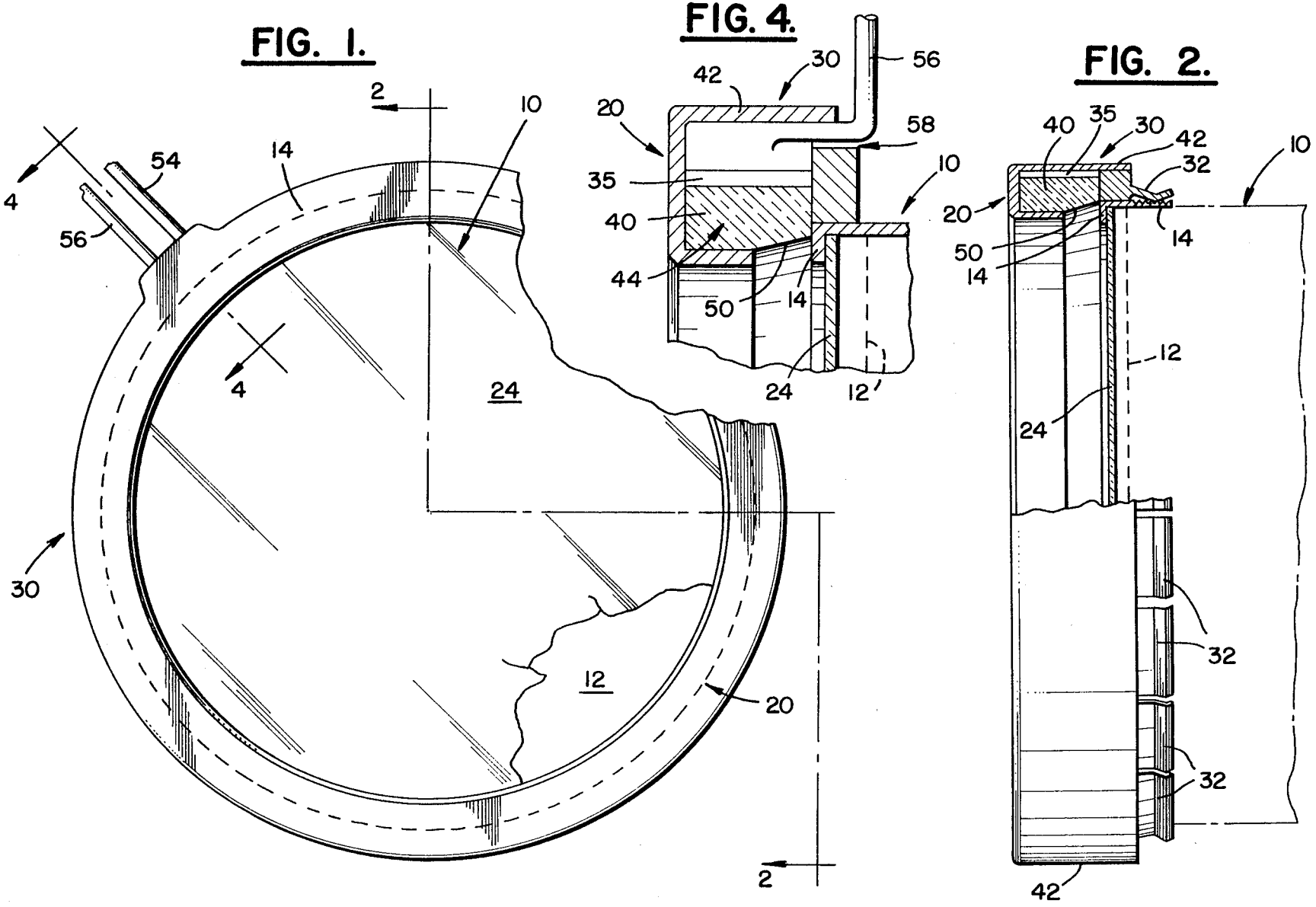
FIG. 1 is a partially cut away planar view of an aircraft instrument replete with a lighting fixture configured in accordance with the invention.
FIG. 2 is a sectional view of the instrument and lighting fixture as viewed from the line 2—2 of FIG. 1.
FIG. 4 is a sectional view of the lighting fixture as viewed from line 4—4 of FIG. 1.

Turning to FIGS. 1 and 2, a typical aircraft instrument 10 with dial (face) 12, and bezel housing 14, are seen with the electroluminescent lighting fixture of the invention 20. As is typical of most aircraft instruments, the instrument dial 12 of instrument 10 is covered by a glass or plastic window 24 which is spaced from and generally parallel to the dial surface. The window 24 is held in place by the bezel 14, as the bezel 14 and window 24 extend out of the instrument panel. The lighting fixture of the invention is generally cylindrical in shape and circumscribes at least part of the outer walls of the instrument that extend out of the instrument panel. As is best seen in FIG. 2, the lighting fixture 20 is designed to snap onto, and sit down around the bezel 14. Thus, lighting fixture 20 has a frame 30 which includes a finger 32 that is designed to mate with the grooves of the bezel so as to hold the lighting fixture in place. In this manner, the lighting fixture is easily attached or removed from the instrument 10. Moreover, this arrangement permits the EL strip and lens of the fixture to lie substantially adjacently above the plane or window 24 with advantages that will be discussed hereinafter.

Electroluminescent lighting fixture 20 generally comprises frame 30, EL strip (lamp) 35, and lens 40 as is best seen in FIGS. 2 and 3. Frame 30 includes finger 32 for mating with bezel 14, and shell 42 which acts as a barrier to light emanating from EL lamp 35. In the particular embodiment seen in FIG. 2, shell 42 extends as an outer wall from the outside of finger 32 to beyond the plane of window 24 in a manner normal to the plane of window 24; then (as a ceiling) makes a ninety degree turn towards the inside of the cylinder adjacent the top of the lamp 35 and lens 40 in a manner parallel to the plane of window 24; and then as an inner shield makes a ninety degree turn towards the window 24. In essence, shell 42 provides an alcove 44 for EL lamp 35 and lens 40 such that light may be piped from EL lamp 35 through lens 40 towards instrument 10, while viewers of instrument 10 are prevented from seeing the EL lamp when facing the instrument panel. Thus, shell 42 is configured to partially surround the lamp and lens. Because of this configuration, however, shell 42 restricts the field of vision of the instrument dial surface 12 as it extends beyond the plane of window 24. Indeed, as suggested by FIG. 3, the farther lighting fixture 20 extends beyond window 24, the more limited is the field of vision. Thus, the features of the fixture which permit the EL strip and lens to lie adjacently above window 24 help reduce the restrictions on the field of vision. To further reduce the inconvenience, an improved frame is shown in FIG. 3. As seen in the FIG. 3 embodiment, the shell 42 only makes an approximate sixty degree turn towards window 24. In this manner, side viewing is extended. The trade-off for the enhanced vision provided by the shell of FIG. 3 is the increased complexity of the shape of lens 40. In the FIG. 3 embodiment, the cross section of lens 40 has five sides being angled sharply, while in the FIG. 2 embodiment, only four of the five sides are angled sharply.

Inside the alcove 44 provided by shell 42, EL lamp 35 and lens 40 are arranged with EL lamp 35 preferably adjacent the outer wall of shell 42 running height-wise from the top of finger 32 up to the ceiling of shell 42. Of course, as is indicated by FIGS. 1 and 2, EL lamp 35 is essentially cylindrical in shape as the length of EL lamp 35 is formed into a circle which is substantially concentric with the dial of instrument 10. Lens 40 is arranged to be adjacent EL lamp 35 with a similar height and with a shape of a modified cylinder or torus. The important aspect of the shape of lens 40 is that at least one non-shielded face (denoted by 50) is provided which faces inward towards the inside of the cylinder and which is angled from the normal to the plane of the dial surface of instrument 10. This face permits light produced by EL lamp 35 to be directed by the lens and to exit the lens such that the instrument dial 12 is properly lighted.

For optimal lighting, the angle which the non-shielded face of the lens makes with the normal to the plane of the dial surface is chosen according to the size of the instrument dial and the distance between the top point of the non-shielded face to the dial surface. By extending a line from the top point of the non-shielded face to the furthermost point on the dial to be illuminated (as seen in phantom in FIG. 6), the angle (denoted as $\theta$) formed between the dial face and the extended line provides the approximate optimal angle at which the face should be angled from the normal to the plane of the dial surface. Thus, for a two inch dial which is only slightly obstructed due to the lighting fixture, and a lighting fixture with the top point of the non-shielded face extending 0.25 inches above the dial face, the angles between six and eleven degrees all provide relatively uniform lighting, with an angle of eight degrees from the normal to the plane of the dial surface of instrument 10 believed to be optimal for uniformity of lighting. Those skilled in the art will appreciate that given the same height between the dial and the top of the unshielded face, the smaller the dial, the greater will be the optimal angle. Likewise, given the same height, the greater the dial diameter, the smaller will be the optimal angle.

To reiterate, with shell 42 shielding all other faces of lens 40, light emanating from EL lamp 35 is reflected by shell 42 and may exit the alcove 44 only by being channelled by lens 40 in a manner perpendicular to face 50 of the lens. Thus, with a two inch dial, almost all of which is to be lit, and with the top of non-shielded face 50 extending 0.25 inches above dial face 12, according to the invention, face 50 should be approximately angled at an angle slightly greater than that having a trigonometric tangent equal to 0.125 (0.25/2). Since an angle of slightly greater than seven degrees has the requisite tangent, face 50, through which the light leaves lighting fixture 20, is chosen to be angled at eight degrees relative to the plane of the face of instrument 10, and uniformly illuminates the dial surface 12 and pointers located thereon. While, in this case, eight degrees is optimal, angles from six to eleven degrees have been found to provide sufficient uniformity in illumination, and are considered within the "approximate" range.

In some circumstances and applications, it is desirable to brighten the pointers or indicators located between the dial face and the cover of the instrument. In order to brighten the pointers (indicators) relative to the dial face, two non-shielded faces are provided on the lens 40 as seen in FIG. 5. Face **50*a* is preferably used to primarily light the pointers, while face 50*b* is used to illuminate both the dial face and the pointers. Again using a two inch instrument as reference, a desired arrangement might be to have faces 50*a* and 50*b* of equal length with face 50*a* at a five or six degree angle from the normal to the dial surface and face 50*b*** at an eight degree angle. Of course, the exact angles, the relative sizes of the two faces, and which face is angled at which angle may all be varied to achieve particular desired results.

Because light from EL lamp 35 may only escape through face 50 of lens 40, theoretically, one hundred percent of the emitted light is utilized in illuminating dial surface 12. This efficiency permits dial surface 12 to be illuminated brightly when desired such that sufficient light is provided to permit viewing by an unaided human eye. Also because night vision devices are not sensitive to the spectral frequency of the green phosphor EL lamp, the degree of illumination need not be changed when viewing through night vision devices. If less light is needed or desired, however, the current flowing to EL lamp 35 through wire lead 54 may be reduced through the use of a potentiometer or the like. As seen in FIGS. 1 and 4, wire leads 54 and 56 are provided to conduct the electricity required to power the EL lamp 35. The leads are connected to one end to any suitable power source, and on the other end to EL lamp 35. Thus, a channel 58 is provided through the extended outer wall of frame 30.

It may also be desirable to pigment lens 40 to effectuate a reduction in intensity and a reduction in reflection from the instrument window 24. The color of pigmentation may be chosen during the manufacturing process depending on how sharp in intensity reduction is desired, and/or according to individual requirements and tastes. It will be recognized by those skilled in the art that the combination of the shape of lens 40 and the color pigmentation of the lens eliminates undesired reflections and glare while providing a proper light intensity and a uniform illumination of the instrument.

Turning to FIG. 6, a cross section of a lighting fixture compatible with a square instrument which embodies many aspects of the invention is seen. The fixture 20 comprises a frame 30, EL lamp 35, and lens 40, and is arranged such that EL lamp 35 and lens 40 are located adjacently above window 24. Frame 30 provides an alcove for EL lamp 35 and lens 40 to shield viewers of instrument 10 from direct viewing of EL lamp 35. For a two inch instrument, lens 40 is shaped such that face 50 is angled at about six to eleven degrees from the normal to the plane of window 24 (or face 12). The fixture differs from that of FIGS. 1–4 mainly in that frame 30 does not include a finger for gripping a bezel because no bezel is provided. Instead, frame 30 has the outer wall of shell 42 with an increased thickness which extends as far as plate 62 and which is wide enough to permit a screw or bolt to pass through for fastening to plate 62. Thus, it will be readily apparent that the invention provides lighting fixtures compatible with round, square, or otherwise shaped instruments of varying sizes.

A cross section of the outer part of an instrument having the lighting fixture of the invention incorporated therein is seen in FIG. 7. As with the other embodiments described hereinbefore, a frame, EL lamp and lens are included with the frame forming an alcove for the EL lamp and lens. The lens is shaped such that the face 50 is optimally angled from the normal to the dial surface. The main differences between the fixture of FIG. 7 and the other fixture embodiments are that frame 30 is attached directly through dial surface 12, and that due to the fact that window 24 is extended out to cover the ceiling of the frame, less light and different pigmentation might be desirable because of the naturally reduced glare and reflection. Those skilled in the art will appreciate that many variations may be made to the details of the manner in which the fixture is incorporated within the instrument without varying from the scope and teachings of the invention.

There has been described and illustrated herein electroluminescent lighting fixtures which are compatible with night viewing either by the naked eye or through night vision devices, and which produce a uniformity of illumination without reflection or glare. The lighting fixtures described are inexpensive and are easily attached to existing aircraft instruments. Moreover, the invention provides for a lighting fixture with excellent uniformity of illumination which can be mounted within the instrument enclosure during manufacture of the instrument. While particular embodiments of the invention have been described, it is not intended that the invention be limited thereby, as it is intended that the invention be broad in scope and that the specifications be read likewise. Thus, those skilled in the art will appreciate that while it is beneficial to pipe the light out of the fixture at certain optimal angles, various beneficial aspects of the invention will be gained even if the angle is outside the optimal range. Likewise, while it is preferable for the EL strip and lens of the fixture to lie adjacently above the instrument face cover, it is not necessary to have such an arrangement. Moreover, while the invention was described with elements such as the lens and lamp having a "top", it will be understood that directional descriptions are relative and are not intended to be restrictive in any manner. Therefore, it will be apparent to those skilled in the art that other changes and modifications may be made to the invention as described in the specification without departing from the spirit and scope of the invention as so claimed.

We claim:

1. A lighting fixture for illuminating an instrument having a dial, the lighting fixture comprising:

(a) an electroluminescent lamp of substantially cylindrical shape;

(b) a lens located adjacent said electroluminescent lamp for piping light emanating from said lamp through at least one face of said lens towards said instrument dial, said one face being angled from the normal to said instrument dial at approximately the angle made between the plane of said instrument dial and the line defined by the top point of said light piping face and the furthermost point of the dial to be illuminated; and (c) a frame configured to partially surround said lamp and said lens so as to allow light to leave said lens and illuminate said instrument but to prevent viewers of said instrument from directly viewing said lamp.

2. A lighting fixture according to claim 1 wherein:

said lens is pigmented.

3. A lighting fixture according to claim 1 wherein:

said lighting fixture is generally cylindrical in shape; and said frame extends along the outside of said lighting fixture and adjacent said lamp, turns approximately ninety degrees along the top of said lamp and said lens, and turns inward toward said instrument dial and adjacent a face of said lens.

4. A lighting fixture according to claim 3 wherein:

said inward turn of said frame is at ninety degrees to the portion of said frame along the top of said lamp and said lens.

5. A lighting fixture according to claim 3 wherein:

said inward turn of said frame is at approximately sixty degrees to the portion of said frame along the top of said lamp and said lens.

6. A lighting fixture according to claim 3 for illuminating the dial of an instrument having a window spaced from but parallel to said instrument dial, wherein:

said lamp and said lens are located substantially adjacently above said instrument window.

7. A lighting fixture according to claim 3 for illuminating the dial of an instrument having a window spaced from but parallel to said instrument dial, wherein:

said lamp, said lens, and said frame are located between the plane of said instrument dial and the plane of said instrument window.

8. A lighting fixture according to claim 1 for illuminating the dial of an instrument having a window spaced from but parallel to said instrument dial, wherein:

said lamp and said lens are located substantially adjacently above said instrument window.

9. A lighting fixture according to claim 1 for illuminating the dial of an instrument having a window spaced from but parallel to said instrument dial, wherein:

said lamp, said lens, and said frame are located between the plane of said instrument dial and the plane of said instrument window.

10. A lighting fixture for illuminating an instrument having a dial, indicators and a window, said indicators being located between the dial and the window, comprising:

(a) an electroluminescent lamp;

(b) a lens located adjacent said electroluminescent lamp for piping light emanating from said lamp through at least two faces of said lens towards said instrument dial and indicators, a first face of said lens being angled to light said dial and said indicators, and a second face of said lens being angled to primarily light said indicators; and (c) a frame configured to partially surround said lamp and said lens so as to allow light to leave said lens and illuminate said instrument but to prevent viewers of said instrument from directly viewing said lamp.

11. A lighting fixture according to claim 8 for illuminating the dial of an instrument having an outer bezel, wherein:

said frame includes a finger for mating with said bezel.

12. A lighting fixture according to claim 10 wherein:

said lighting fixture is generally cylindrical in shape; and said frame extends along the outside of said lighting fixture and adjacent said lamp, turns approximately ninety degrees along the top of said lamp and said lens, and turns inward toward said instrument dial and adjacent a face of said lens, said inward turn of said frame being at approximately sixty degrees to the portion of said frame along the top of said lamp and said lens.

13. A lighting fixture according to claim 10 wherein:

said first face is angled from the normal to said instrument dial at approximately the angle made between the plane of said instrument dial and the line defined by the top point of said light piping face and the furthermost point of the dial to be illuminated.

14. A lighting fixture according to claim 10 wherein:

said lens is pigmented.

15. A lighting fixture according to claim 10 where the instrument has an approximately two inch diameter dial, wherein:

said first face is angled at about eight degrees from the normal to said instrument dial; and said second face is angled at about five to six degrees from the normal to said instrument dial.

16. A lighting fixture according to claim 12 for illuminating an instrument with a dial and a window spaced from but parallel to said instrument dial, wherein:

said lamp and said lens are located substantially adjacently above said instrument window.

17. A lighting fixture according to claim 12 for illuminating an instrument with a dial and a window spaced form but parallel to said instrument dial, wherein:

said lamp, said lens, and said frame are located between the plane of said instrument dial and the plane of said instrument window.

18. A lighting fixture according to claim 12 for illuminating an instrument having an outer bezel, wherein:

said frame includes a finger for mating with said bezel.

19. A lighting fixture according to claim 12 for illuminating an instrument with a dial and a window spaced from but parallel to said instrument dial, wherein:

said lamp, said lens, and said frame are located between the plane of said instrument dial and the plane of said instrument window.

20. A lighting fixture according to claim 1 where the instrument has an approximately two inch diameter dial, wherein:

said one face is angled at between six and eleven degrees from the normal to the instrument dial.

21. A lighting fixture according to claim 20, wherein:

said one face is angled at eight degrees from the normal to said instrument dial.

22. A lighting fixture according to claim 10, wherein:

said electroluminescent lamp is substantially cylindrical in shape.

* * * * *